US005213204A

United States Patent [19]

Sommer

[11] Patent Number: 5,213,204

[45] Date of Patent: May 25, 1993

[54] ROCKER SWITCH

[75] Inventor: Edward S. Sommer, Addison, Ill.

[73] Assignee: Molex Incorporated, Lisle, Ill.

[21] Appl. No.: 793,752

[22] Filed: Nov. 18, 1991

[51] Int. Cl.[5] ..... H01H 9/02

[52] U.S. Cl. ..... 200/303; 200/5 R; 200/553; 200/339; 200/332.1

[58] Field of Search ..... 200/5 R, 5 E, 517, 553, 200/556, 557, 293, 303, 302.3, 315, 339, 330, 331, 332.1, 333, 332

[56] References Cited

U.S. PATENT DOCUMENTS

| | | | |
|---|---|---|---|
| 2,794,890 | 6/1957 | Taylor | 200/339 X |
| 2,860,212 | 11/1958 | Stearn | 200/553 X |
| 3,155,806 | 11/1964 | Klingenberg | 200/5 R |
| 4,166,935 | 9/1979 | Norby | 200/5 E X |
| 4,336,429 | 6/1982 | Jackson | 200/408 |
| 4,401,864 | 8/1983 | Ichikawa | 200/17 R |
| 4,429,200 | 1/1984 | Glenn | 200/332.1 |
| 4,485,282 | 11/1984 | Lee | 200/293 X |
| 4,654,488 | 3/1987 | Westfall | 200/517 X |
| 4,739,127 | 4/1988 | Higuchi | 200/5 R |
| 4,837,411 | 6/1989 | Best | 200/339 X |
| 4,883,932 | 11/1989 | Van Hout | 200/339 |
| 4,920,238 | 4/1990 | Aso | 200/6 R |
| 4,929,804 | 5/1990 | Kawai | 200/5 A |
| 4,943,694 | 7/1990 | Kroth | 200/332.1 |
| 4,947,008 | 8/1990 | Sato et al. | 200/339 X |
| 5,053,592 | 10/1991 | Zuercher | 200/517 X |
| 5,059,754 | 10/1991 | Kaichi et al. | 200/293 X |
| 5,087,798 | 2/1992 | Rohde et al. | 200/339 X |
| 5,095,409 | 3/1992 | Dematteo et al. | 200/315 X |

FOREIGN PATENT DOCUMENTS

| | | | |
|---|---|---|---|
| 1665863 | 1/1971 | Fed. Rep. of Germany | 200/339 |
| 3719793 | 12/1988 | Fed. Rep. of Germany | 200/556 |

*Primary Examiner*—Henry J. Recla
*Assistant Examiner*—Glenn T. Barrett
*Attorney, Agent, or Firm*—Stephen Z. Weiss

[57] ABSTRACT

An electrical switch assembly is disclosed to include a self-contained switch unit having a pair of depressible operators. A rocker actuator is rockably mounted about a rotational axis overlying the switch unit with wing portions of the actuator disposed on opposite sides of the rotational axis for alternatingly engaging the depressible operators. A two-part housing includes a base part and a cover part. The base part has a receptacle for mounting the self-contained switch unit. The cover part rockably mounts the rocker actuator. The two housing parts have complementary interengaging latches for snapping the parts into latched interengagement. The base part and the self-contained switch unit have complementary interengaging snap latches for snapping the switch unit into latched interengagement with the base part. The rocker actuator and the cover part have complementary interengaging snap latches for snapping the rocker actuator into latched interengagement with the cover part.

9 Claims, 2 Drawing Sheets

ROCKER SWITCH

FIELD OF THE INVENTION

This invention generally relates to the art of electrical switches and, particularly, to an electrical switch assembly having a rocker actuator rockably mounted about a rotational axis.

BACKGROUND OF THE INVENTION

Rocker switches are used in a variety of applications for alternatingly actuating a pair of switches of a switching unit. A rocker-type electrical switch assembly generally includes a rocker actuator rockably mounted about a rotational axis overlying the switch unit, with wing portions of the rocker actuator projecting from opposite sides of the rotational axis for alternatingly engaging depressible operators of the switch unit. In other words, the rocker actuator pivots in a seesaw fashion to actuate one or the other of a pair of switch operators. The switches of the switching unit may be of various types, such as momentary switches, micro-switches or the like.

One of the problems with rocker-type switches is that they often are used in low-cost environments. However, the rocker switch assembly, itself, usually is a comparatively high-cost item because such switch assemblies, heretofore, have been relatively complicated and/or included numerous components such as housing parts, mounting parts, and fastening components to maintain the parts in assembled condition. Such expenses are particularly bothersome when the switch unit used within the rocker switch assembly often is a self-contained unit which is readily obtainable. This invention is directed to providing a very simple, relatively inexpensive electrical switch assembly of the rocker-type wherein all of the parts of the assembly, even the switch unit itself, are held in assembled condition by snap-fit latching means, obviating any extraneous or separate latching components.

SUMMARY OF THE INVENTION

An object, therefore, of the invention is to provide a new and improved electrical switch assembly of the rocker actuator type.

Specifically, the electrical switch assembly includes a self-contained switch unit having a pair of depressible operators. A rocker actuator is rockably mounted about a rotational axis overlying the switch unit with wing portions on opposite sides of the rotational axis alternatingly engageable with the depressible operators.

The invention contemplates the provision of a two-part housing including a base part and a cover part. The base part has receptacle means for mounting the self-contained switch unit. The cover part has mounting means for rockably mounting the rocker actuator. The two housing parts have complementary interengaging latch means for snapping the parts into latched interengagement.

The invention also contemplates that the receptacle means include snap latch means for mounting the self-contained switch unit on the base part of the two-part housing, and that the rocker actuator mounting means also include snap latch means for rockably mounting the rocker actuator on the cover part of the two-part housing.

The rocker actuator includes fulcrum means defining its rotational axis. The snap latch means are operatively associated between the fulcrum means and the cover part of the two-part housing.

Another feature of the invention involves the use of a switch unit wherein the depressible actuators are illuminated, and wherein the wing portions of the rocker actuator include light transmitting means. Specifically, the rocker actuator is fabricated of translucent material, and the wing portions thereof have thin area for transmitting light therethrough, the light being more intense through the wing portion which is engaged with its respective depressible actuator of the switch unit.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
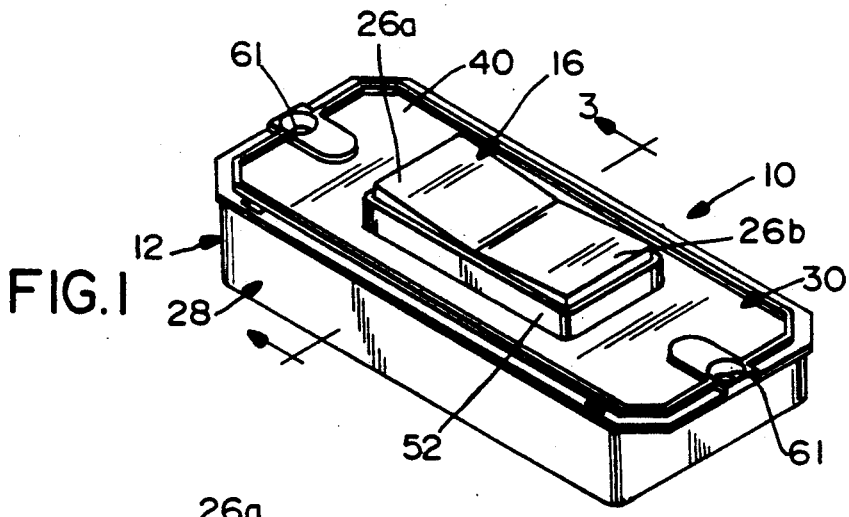
FIG. 1 is a perspective view of an electrical switch assembly embodying the concepts of the invention.

Referring to the drawings in greater detail, the invention is embodied in an electrical switch assembly, generally designated 10 (FIG. 1), which includes a two-part housing, generally designated 12, for mounting a self-contained switch unit, generally designated 14 (FIG. 2) therewithin. The switch unit is actuated by a rocker actuator, generally designated 16.

Figure 2:
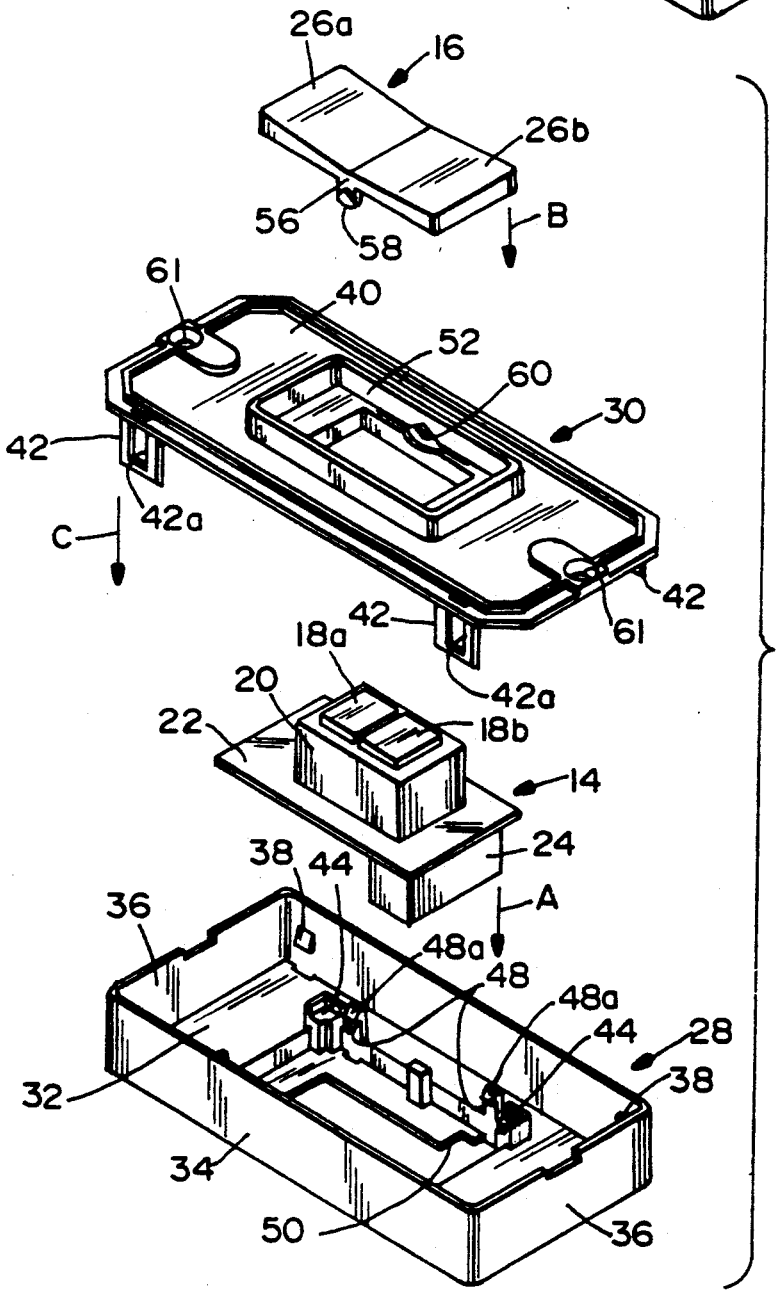
FIG. 2 is an exploded perspective view of the various components of the switch assembly.

More specifically, and referring to FIG. 2, self-contained switch unit 14 is a readily available momentary switch device which includes a pair of depressible actuators **18*a* and 18*b* mounted on top of a block 20 which houses various switching components. The block is mounted on top of a printed circuit board 22, with other switching components 24 extending from the bottom of the printed circuit board. As will be described in greater detail hereinafter, rocker actuator 16 is rockably mounted about a rotational axis overlying switch unit 14, with wing portions 26*a* and 26*b* of the rocker actuator, on opposite sides of its rotational axis, alternatingly engageable with depressible operators 18*a* and 18*b*, respectively, of switch unit 14**.

Two-part housing 12 includes a base housing part, generally designated 28, and a cover housing part, generally designated 30. The base part has receptacle means, described hereinafter, for mounting self-contained switch unit 14, and the cover part has mounting means, described hereinafter, for rockably mounting rocker actuator 16. The two housing parts have complementary interengaging latch means for snapping the parts into latched engagement without requiring any extraneous or separate latching or assembly components.

More particularly, base housing part 28 is generally box-shaped and includes a bottom wall 32 (FIG. 2), sidewalls 34 and end walls 36. Both housing parts are unitarily molded of dielectric material such as plastic or the like, and each sidewall 34 of base part 28 has a pair of ramped detent latches 38 molded integrally therewith and projecting inwardly therefrom.

Cover housing part 30 includes a generally planar wall 40. The perimeter of the planar wall seats on top of the top edges of sidewalls 34 and end walls 36 of base housing part 28 as shown in FIG. 1 in the assembled condition of the switch assembly. A pair of latch arms 42 project downwardly from each side of the cover housing part, spaced slightly inwardly from the edge of planar wall 40, so that the latch arms are located along the inside of sidewalls 34 of the base housing part when in the assembled condition of the switch assembly The latch arms have openings 42*a* which align with ramped detent latches 38 of the base housing part so that when the cover part is assembled on top of the base part, the latch arms snap into latched interengagement with the detent latches to hold the two housing parts in assembled condition.

Generally, base housing part 28 includes receptacle means for mounting self-contained switch unit 14. Specifically, four corner ledges 44 are molded integral with the base housing part and project upwardly from bottom wall 32 for receiving the corners of printed circuit board 22 of switch unit 14. A polarizing rib 46 may be provided for positioning in a polarizing slot (not shown) in the printed circuit board. Snap latch means in the form of four hooked latches 48 project upwardly from bottom wall 32, the hooked latches having upper camming surfaces 48*a*. Therefore, when switch unit 14 is assembled into base housing part 28 in the direction of arrow "A" (FIG. 2), the side edges of printed circuit board 22 engage cam surfaces 48*a* of hooked latches 48 to cam the latches outwardly until the hook portions of the latches snap into engagement over the top surface of the printed circuit board as the printed circuit board seats onto corner ledges 44. An opening 50 is provided in bottom wall 32, through which switching components 24 of the switch unit can project.

Figure 4:
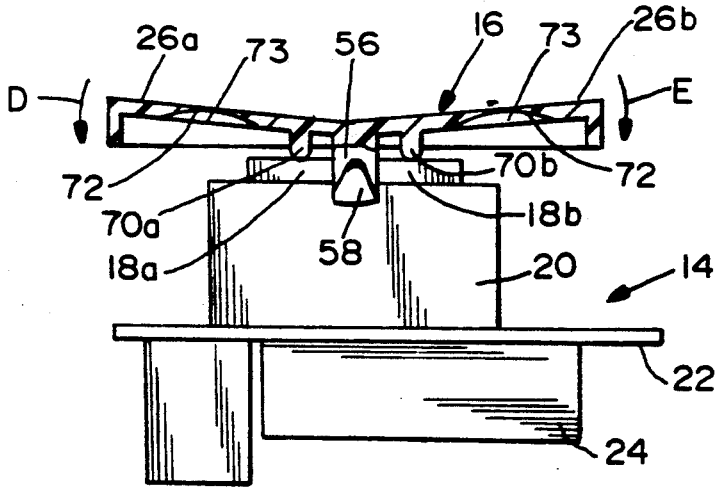
FIG. 4 is a side elevational view of the rocker actuator isolated from the other components of the switch assembly, in conjunction with the self-contained switch unit.

Generally, cover housing part 30 includes mounting means for rockably mounting rocker actuator 16. Specifically, a recessed area is provided on the top of cover housing part 30 by means of a generally rectangular rib structure 52 and within which rocker actuator 16 is disposed. Referring to FIG. 4 in conjunction with FIG. 2, a pair of fulcrum tabs 56 project downwardly from a midpoint of the rocker actuator at opposite sides thereof. Each fulcrum tab 56 includes a generally triangular latch boss 58 projecting laterally outwardly therefrom. The outside face of each latch boss 58 is tapered outwardly to provide a cam surface. As seen in FIG. 2, cover housing part 30 includes a pair of fan-shaped latch recesses 60 which are partially formed in both planar wall 40 and rib structure 52, for snappingly receiving latch bosses 58. In assembly, rocker actuator 16 is assembled to cover housing part 30 in the direction of arrow "B" (FIG. 2). As assembled, fulcrum tabs 56 slide inside rib structure 52 and are biased inwardly by the tapered outside faces of latch bosses 58 so that the latch bosses can snap outwardly into latched positions in latch recesses 60. Lastly, cover housing part 30 has a pair of apertures 61, such as internally threaded holes, for receiving fastening means, such as screws, to mount the switch assembly aligned with an opening in a wall or panel.

Various sequences of assembly of electrical switch assembly 10 are contemplated with the simple construction of the complementary interengaging snap-latch components of the assembly. For instance, self-contained switch unit 14 can be snapped into latched condition within base housing part 28 in the direction of arrow "A" (FIG. 2), as described above; and rocker actuator 16 can be snapped into cover housing part 30, as described above. The two housing parts, along with their assembled switch unit and rocker actuator, then can be snapped into assembled condition in the direction of arrow "C". Or, the switch unit can be assembled to the base housing part, the cover housing part then can be assembled to the base housing part, and rocker actuator 16 then can be snapped into position onto the cover housing part. It can be seen that any or all of these snap-latch interengagements between the components of the switch assembly are carried out to assemble the entire electrical switch assembly without any extraneous or separate latching, mounting or assembly components whatsoever.

Figure 3:
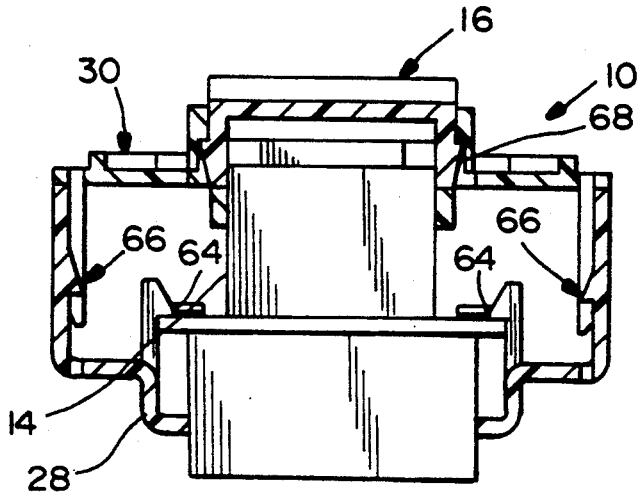
FIG. 3 is a vertical section, on an enlarged scale, taken generally along line 3—3 of FIG. 1.

Recapitulating, and referring to FIG. 3, self-contained switch unit 14 is snap-latched into assembled condition within base housing part 28 in the areas generally indicated at 64. Upper housing part 30 is snapped into latched interengagement with base housing part 28 in the areas generally indicated at 66. Rocker actuator 16 is snapped into latched interengagement with cover housing part 30 in the areas generally indicated at 68.

Referring to FIG. 4, rocker actuator 16 is shown isolated in conjunction with self-contained switch unit 14 and the depressible actuators 18*a* and 18*b* thereof. The rocker actuator is unitarily molded of dielectric material and includes a pair of transverse ribs 70*a* and 70*b* depending from the underside thereof and in alignment, respectively, with depressible operators 18*a* and 18*b*. Therefore, if an operator pushes down on wing portion 26*a* of the rocker actuator, in the direction of arrow "D", rib 70*a* will depress operator 18*a* to actuate the switch components operatively associated therewith. Usually, the depressible operators of these types of self-contained switch units are spring loaded, particularly when the switch unit is a momentary switch. Therefore, when the operator releases pressure on wing portion 26*a*, the rocker actuator will return to the neutral position shown in FIG. 4. Likewise, if the operator depresses wing portion 26*b* of rocker actuator 16 in the direction of arrow "E", rib 70*b* will depress operator 18*b* to actuate the switching components of the switch unit operatively associated with that operator. Again, upon release, the rocker actuator will return to its neutral position under the biasing of depressible operator 18*b*.

Lastly, FIG. 4 shows another feature of the invention which involves a visual indication of proper switch actuation. Specifically, many momentary switch units such as self-contained switch unit 14, include means for illuminating depressible operators 18*a* and 18*b*. For instance, the operators may be illuminated when depressed. Therefore, the invention contemplates molding rocker actuator 16 of translucent plastic material, and molding depressions 72 in the underside of wings portions 26*a* and 26*b* to "thin" the rocker actuator, as at 73, on opposite sides of the rotational axis thereof. Therefore, if the rocker actuator is pivoted in the direction of arrow "D" to actuate depressible operator 18*a* and to illuminate the same, the depression 72 in the underside of wing portion 26*a* will be closer to depressible operator 18*a* than the depression in the underside of wing portion 26*b*, thereby transmitting more light therethrough and indicating a condition of switch actuation.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical switch assembly which includes a self-contained switch unit having a pair of depressible operators, and a rocker actuator rockably mounted about a rotational axis overlying the switch unit with wing portions disposed on opposite sides of the rotational axis for alternatingly engaging the depressible operators, the improvement comprising a two-part housing including a base part and a cover part, the base part having receptacle means including switch snap latch means for mounting the self-contained switch unit on the base part of the two part housing, the cover part having mounting means for rockably mounting the rocker actuator, and the two parts having complementary interengaging latch means for snapping the parts into latched interengagement.

2. In an electrical switch assembly as set forth in claim 1, wherein said mounting means include rocker snap latch means for rockably mounting the rocker actuator on the cover part of the two-part housing.

3. In an electrical switch assembly as set forth in claim 2, wherein said rocker actuator includes fulcrum means defining said rotational axis, and said rocker snap latch means is operatively associated between the fulcrum means and the cover part.

4. In an electrical switch assembly as set forth claim 1, wherein the depressible actuators of the self-contained switch unit are illuminated, and wherein the improvement comprises light transmitting means in the wing portions of the rocker actuator.

5. In an electrical switch assembly as set forth in claim 4, wherein said rocker actuator is fabricated of translucent material and the wing portions thereof have thin areas for transmitting light therethrough.

6. In an electrical switch assembly as set forth in claim 1, wherein said base and cover parts of the two-part housing each is unitarily molded of plastic material.

7. In an electrical switch assembly which includes a self-contained switch unit having a pair of depressible operators, and a rocker actuator rockably mounted about a rotational axis overlying the switch unit with wing portions on opposite sides of the rotational axis for alternatingly engaging the depressible operators, the improvement comprising a housing for mounting the self-contained switch unit and for rockably mounting the rocker actuator, the housing and the rocker actuator having rocker snap latch means for latching the rocker actuator into latched interengagement with the housing and the housing further including receptacle means having switch snap latch means for mounting the self-contained switch unit on the housing.

8. In an electrical switch assembly as set forth in claim 7, wherein said rocker actuator includes fulcrum means defining said rotational axis, and said rocker snap latch means are operatively associated between the fulcrum means and the housing.

9. In an electrical switch assembly as set forth in claim 7, wherein said rocker actuator and at least a portion of the housing to which the rocker actuator is rockably mounted each is unitarily molded of plastic material.

* * * * *